US008752454B2

(12) United States Patent
Friend et al.

(10) Patent No.: US 8,752,454 B2
(45) Date of Patent: Jun. 17, 2014

(54) THREAD PROTECTOR MANIPULATION TOOL

(76) Inventors: Brian Friend, Calgary (CA); Ernie Loveless, Beaverlodge (CA)

( * ) Notice: Subject to any disclaimer, the term of this patent is extended or adjusted under 35 U.S.C. 154(b) by 281 days.

(21) Appl. No.: 13/081,280

(22) Filed: Apr. 6, 2011

(65) Prior Publication Data

US 2012/0255402 A1 Oct. 11, 2012

(51) Int. Cl.
*B25B 13/04* (2006.01)

(52) U.S. Cl.
USPC ..... 81/120; 81/53.2; 81/442; 81/448

(58) Field of Classification Search
USPC ..... 81/53.2, 120, 442, 448
See application file for complete search history.

(56) References Cited

U.S. PATENT DOCUMENTS

| | | | | |
|---|---|---|---|---|
| 4,314,723 | A * | 2/1982 | Vermillion | 81/53.11 |
| 4,337,799 | A * | 7/1982 | Hoover | 138/96 T |
| 4,442,737 | A * | 4/1984 | Miner | 81/448 |
| 5,490,438 | A * | 2/1996 | Zupo et al. | 81/53.11 |

* cited by examiner

*Primary Examiner* — Lee D Wilson
*Assistant Examiner* — Shantese McDonald
(74) *Attorney, Agent, or Firm* — Bennett Jones LLP

(57) ABSTRACT

A system is provided to facilitate the substitution of power tools for manual manipulation of thread protectors on threaded tubulars. Male-thread protectors are manipulated using a driven cup with a flexible inner liner to engage the protector, the cup having expansion and gripper features. Female-thread protectors are manipulated using a driven elastic body fittably engaged with the inner surface of the protector. The manipulators are fitted with tool adapters to fit power tools such as an impact wrench.

7 Claims, 2 Drawing Sheets

THREAD PROTECTOR MANIPULATION TOOL

FIELD OF THE INVENTION

The present invention relates generally to manipulation (placement, removal, replacement) of thread protectors on tubulars, in particular in pipeline or drilling applications where large industrial scale tubular materials which are threaded for mating are used.

BACKGROUND OF THE INVENTION

Thread Protectors and their Use, Generally:

Where threaded tubular goods are manufactured and transported or stored prior to use, it is usual to provide protection for the treads which have been machined or formed at one or more ends of each tube. It is also typical that threaded tubulars are manufactured for later assembly into a multi-tube conduit, with each tube being joined to at least one other tube using the threads at the end of the tubes; this means that each tube typically will have a male (or "pin") end with threads cut into the outside diametrical surface of the tube, and a female (or "box") end with threads cut into the inside diametrical surface of the other end of the tube; a pin end being designed to threadably connect with a box end of another tube to form a string of tubulars. The box end may be comprised of a fitting of larger outside diameter than the tubular in order to accommodate internal threads with adequate inside diameter to receive matable pin-end threads of another tubular. It can be seen that with two types of threaded end to protect, there are logically two types of thread protectors required.

Threaded protectors are therefore typically either themselves formed to protect the pin-end or the box-end of threaded tubulars, and will thus either be male-thread protectors (protecting the pin-end threads) made to threadably fit onto and over the pin-end threads; or female-thread protectors (protecting the box-end threads) made to threadably fit into and cover the box-end threads.

Male-thread protectors are typically shaped as a cylinder with its internal side-wall machined or formed with threads to attach itself to a pin-end thread on a tubular. The protector may be closed at one end, like a can, or can be open at both ends.

Female-thread protectors are typically shaped roughly as a cylinder, with its external side-wall surface machined or formed with threads to attach itself into the box-end thread of a tubular. The protector may be closed at one or both ends, but is typically open at least at its outer end (when threaded into the box-end thread of the tubular).

When threaded tubulars are manufactured, it is usual for the threaded ends to be protected by installation of thread protectors as described above to be fitted, especially when the tubulars are to be stored or transported prior to use. When the tubulars are ready to be deployed or installed or used in the field (such as to form wellbore casing or drillstem, for example), the thread protectors must be removed before the tubulars can be attached one to the other to form their designed conduit or tubing string. This has typically been done manually by having an operator grasp the protector and turn it by hand until it decouples from the tubular. This process requires repetitive manual motion through a number of rotations of the protector, which promotes repetitive stress injuries and takes time (in the order of 60+ seconds per protector). In a typical well, several hundred tubulars may need to be prepared and connected to form a desired casing or tubing string, and the requirement may need to be met in a short period of time to reduce costs of idled rig equipment.

In the prior art, U.S. Pat. No. 4,442,737 (Miner) identified a potential solution to the issues raised above, and attempts to provide a mechanism for using externally provided rotational forces (such as provided by a hammer-drill or powered torque wrench) to spin thread protectors off (or onto) threaded tubular goods. Miner provides for a thread protector wrench for frictionally pneumatically engaging and removing thread protectors from tubulars; there are two styles of wrench disclosed, both operating on similar principles: a flexible material is deployed adjacent the outer diameter surface of a thread protector (being the surface away from the threads on the tubular onto which the protector is attached), and injecting fluid pressure into the tool to expand the flexible material, forcing it to engage frictionally with the surface of the thread protector; and then rotating the tool and flexible material in order to rotate the thread protector to remove (or replace) it from (or to) the tubular's threads. The Miner tool requires a source of pressurized fluid, fluid flow control means, a means of attaching the pressure source during activation of the engagement function and detaching the pressure source when it is desirable to rotate the tool, as well as inordinate stresses focused on the attachment point of the flexible bladder to the tool's rotation attachment to the external rotation/torque applicator.

It is, therefore, desirable to provide a system and apparatus for overcoming the obstacles in the prior art, reducing materials costs, time to build and associated time-dependent costs, and increasing useable lot space for medium to large-scale construction projects involving excavation and provision of useable basement structures which may also form foundations for the upper building structure.

SUMMARY OF THE INVENTION

To mitigate some of the problems with the prior art, this system provides in an embodiment for a tool to manipulate a thread protector for the female threads of a threaded tubular, comprising: a torque adapter attached to a flexible body, the body being cylindrical or frusto-conical, the body's outer diameter designed to mate with an inner surface of the thread protector, the torque adapter to transmit rotational forces to the protector via the body in order to spin the protector to screw or unscrew it from the threaded tubular.

In another embodiment, it provides a tool to manipulate a thread protector for the male threads of a threaded tubular, comprising: a torque adapter attached to a solid cup, a flexible cup-liner removably attached to the solid cup, the flexible cup-liner shaped to temporarily receive and engage with the outer surface of the thread protector, the solid cup having voids in its cylindrical outer walls, the torque adapter to transmit rotational forces to the protector via the cup and flexible cup-liner in order to spin the protector to screw or unscrew it from the threaded tubular.

In another embodiment, it provides a method of screwing or unscrewing a thread protector from a threaded tubular, comprising the steps of: engaging a source of powered rotational motion to one end of a protector manipulator, engaging a protector-engagement means of the protector manipulator to the protector, invoking powered rotational movement to be supplied from the source to the protector manipulator to turn the protector in a direction, stopping the rotational movement imparted to the protector just before the protector is disengaged from the threaded tubular, disengaging the protector-engagement means of the protector manipulator from the protector.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached figures, wherein.

DETAILED DESCRIPTION

Figure 1:
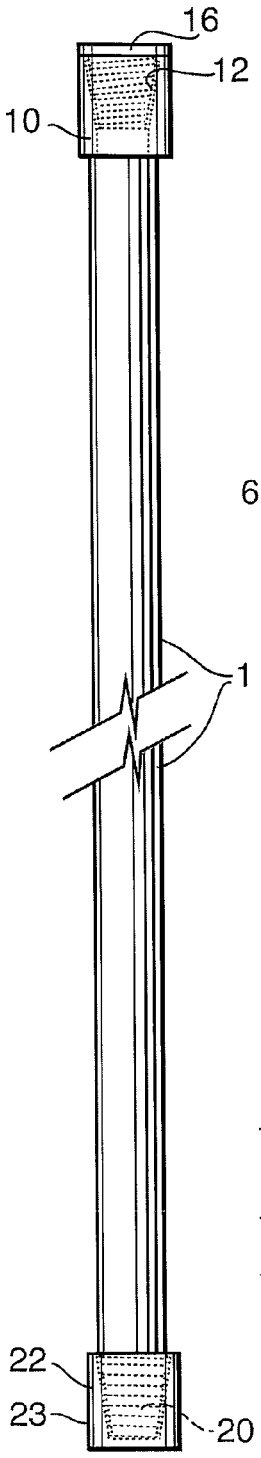
FIG. 1 is a drawing of a threaded tubular with a box end and a pin end.
Figure 2A:
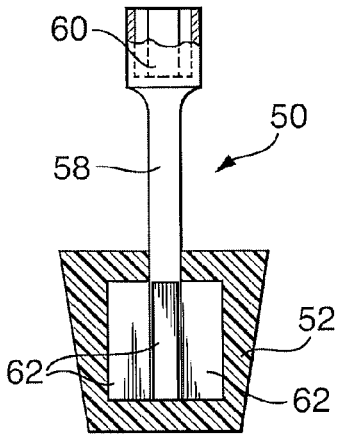
FIG. 2 is a series of three drawings of an exemplar female-thread protector manipulator, showing FIG. 2*a* as a cross-section along a plane intersecting the manipulator along its longitudinal axis.
FIG. 2*b* is an elevation of the manipulator alone.
FIG. 2*c* is a cross-section of the manipulator inserted and engaged with a thread protector which is in turn engaged with the box end female-threads of a threaded tubular, along the same cross-sectional plane as FIG. 2*a*.
Figure 2B:
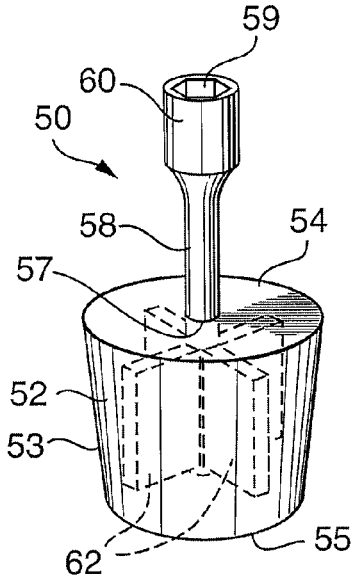
Figure 2C:
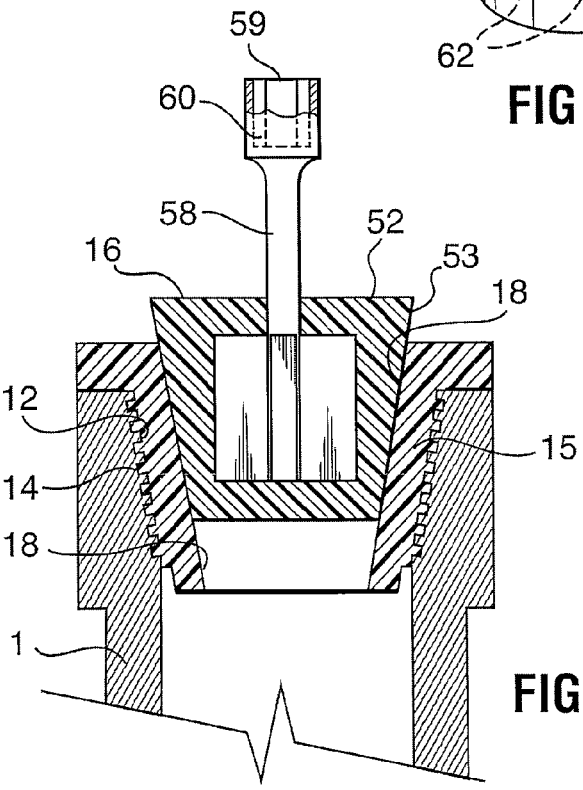

Generally, the present invention provides a method and system for removal or replacement of thread protectors used to protect threaded tubulars during transport and storage before use. Typical removal operations without use of the tool of this invention take in the order of 60 seconds per protector, while the same operation can be completed using the tool in 3-4 seconds. On large projects, where several hundred protectors must be removed during the project, the time (and thus cost) savings can be significant.

Of at least as much importance is the reduction of repetitive stress injuries to the personnel who without the tool must manually manipulate the protectors to turn them off of the tubulars. By using the tool and a power drill or air hammer (or similar rotating drive), the operators are saved from repetitive manual rotation of the protectors for removal (and similarly for replacement).

It is to be noted that the protectors for which this invention are initially directed are those for threaded tubulars of between 2⅜" and 4½", although the invention can work for protectors as large as 30" or greater in diameter.

Construction and Use of an Embodiment of a Female-Thread Protector Removal and Replacement Tool:

A tool 50 is provided for removal or attachment (or reattachment) of female-thread protectors 15 from the box end 10 of threaded tubulars 1. The tool 50 has a flexible solid cylindrical or frustoconical body 52 sized in outside diameter such that its outer surface 53 can be inserted into and connect with the inner surface 18 of a female-thread protector 15, and by application of some linear force pushing the body 52 into the female-thread protector 15 engaging the body 52 with the inner surface 18 of the protector 15.

The body 52 is attached to a torque adapter 60 which permits the tool to be attached to an external device such as a power drill or wrench (not shown) to provide torque to the tool in order to turn/spin the protector 15 out of the box-end 10 of the threaded tubular. An example is a ½" square female receptacle to receive the turning male attachment end of a pneumatic hammer drill.

The torque adapter is aligned substantially along the linear axis of the body 52, extending from one end of the body 52 which is the fat end of the body 52 if it is frustoconical. When the torque adapter is rotated, the tool's body 52 rotates about its internal longitudinal axis.

The torque adapter can comprise a tool connector 59 such as a female receptacle to fit standard socket wrench drivers (not shown) attached to a spindle 58 which is attached to a shaped embedded end 62 which is embedded within the tool's body 52 during manufacture, such as by suspending the adapter 60 over and extending into a mold into which material such as a polymer plastic is poured to form the tool's body 52 encasing the embedded end 62 of the adapter 60 when finished.

The shaped embedded end 62 can comprise a member or members which extend radially from the spindle 58 inside the body 52 of the tool and thereby transfer torque applied through the torque adapter 60 to the body 52 and thus to the protector 15. The member or members can be fins, blades, extrusions, bolts, or any other shape attached to the spindle 58 and extending into the inner body 52 of the flexible solid from which the body 52 is made or formed.

The flexible solid comprising the body 52 may be any suitable polymer which can provide sufficient elasticity to engage with the protector 15, be turned by the spindle's 58 members, and be released when the tool 50 is removed from the protector's body 18 under operating conditions, which can include extreme temperatures and environments such as may be found on drilling or service rigs, or exposed yards or warehouses. An example of such a substance is "General Use—Polyurethane Elastomer—Smooth-On PMC—870 Industrial Liquid Rubber Compound—Polyurethane rubber Shore Hardness: 70 A" produced by Smooth-On, Inc.

frustoconical in this text means a cone-shape the tip of which has been truncated by a plane parallel to the cone's base.

cylindrical in this text refers to a solid with the geometrical shape of a cylinder, the surface of which is formed by the body's two ends which are the intersection of each of two parallel planes perpendicular to the cylinder's longitudinal internal axis, the distance separating those two parallel planes being the length of the cylinder's body, and the surface formed by the points at a fixed distance from the line segment of the body's internal longitudinal axis which surface forms the external sides of the cylindrical body.

The slope of the external sides 53 of the tool's body 52 is designed to facilitate insertion into a matching female-thread protector 15 and engagement with its internal surface 18 with slight linear inward pressure on the tool 50, and ease of removal of the tool's body 52 from the protector 15 when the removal or attachment of the protector 15 from (or to) the tubular 1 is completed. The slope may be designed to suit the style of protector being manipulated, and it has been useful to mold the flexible body 52 using the inner void of an exemplar protector during manufacture of the flexible body 52 and the tool 50.

The operator may spin the protector to unscrew it from the tubular's threads 12 until a point when it is nearly but not quite unscrewed, and then pull the body 52 from the protector 15 while the protector 15 is still engaged with the tubular 1, and then remove the protector 15 by manually spinning it from the threads 12.

Construction and Use of an Embodiment of a Male-Thread Protector Removal and Replacement Tool:

A tool 30 is provided for removal or attachment (or reattachment) of male-thread protectors 22 from the threaded pin end 20 of threaded tubulars 1. The tool 30 has a flexible solid liner 40 in a solid cup 35 sized to frictionally fit onto the outer surface 23 of a male-thread protector 22 and then be rotated or spun about the cup's longitudinal axis by force supplied from an external torque-providing device (not shown) such as a pneumatic hammer drill or wrench attached to the tool 30 by a torque adapter 32 comprised of an adapter tool connection 33 such as a ½" square female receptacle on the end of the torque adapter attached to the adapter's spindle 34 which is in turn attached to the solid cup 35 at the cup's outside bottom surface 38.

The solid cup 35 can be pierced or formed with holes in the cup's outer or lateral cylindrical sides to allow the flexible inner cup liner 41 to be forced outward by insertion of the protector 22 into the void inside the flexible inner cup liner 41 and into those piercings or holes 37. This serves to hold the flexible cup liner 41 from spinning inside the solid cup 35 as well as providing the ability of the flexible cup liner 41 to be displaced by the protector 22.

The solid cup 35 may be made of metal. The adapter spindle 34 may be welded or formed or otherwise mechanically attached to the bottom of the solid cup 38. The adapter 32 may have a tool connector 33 fixed to its outermost end, away from the cup. The tool connector 33 may be a connector such as a ½" or otherwise appropriately sized square socket to receive a mating wrench component.

The flexible solid comprising the cup liner 40 may be any suitable polymer which can provide sufficient elasticity to engage with the protector 22 and the solid cup 35 to be turned by the torque adapter 32, and to release the protector when the protector 22 is removed from the flexible cup liner 40 under operating conditions, which can include extreme temperatures and environments such as may be found on drilling or service rigs, or exposed yards or warehouses. An example of such a substance is "General Use—Polyurethane Elastomer—Smooth-On PMC—870 Industrial Liquid Rubber Compound—Polyurethane rubber Shore Hardness: 70 A" produced by Smooth-On, Inc. The flexible solid liner can have ½" wall thickness, although the thickness can be larger or smaller as conditions require, and can vary to provide an inside cavity which is frustoconical.

The solid cup can be of any suitable solid, and can be metal. The torque adapter can be affixed or formed as a unit with the solid cup, but can be a metal adapter welded or otherwise attached to the bottom of a compatible metal cup.

The voids in the cup's outer circumferential walls can be of any shape, and can be drilled holes spaced in two or three rows running circumferentially around the walls about 1¼" apart with about 1/16th" diameter, or spaced 45 degrees radially apart from one another.

Figure 3A:
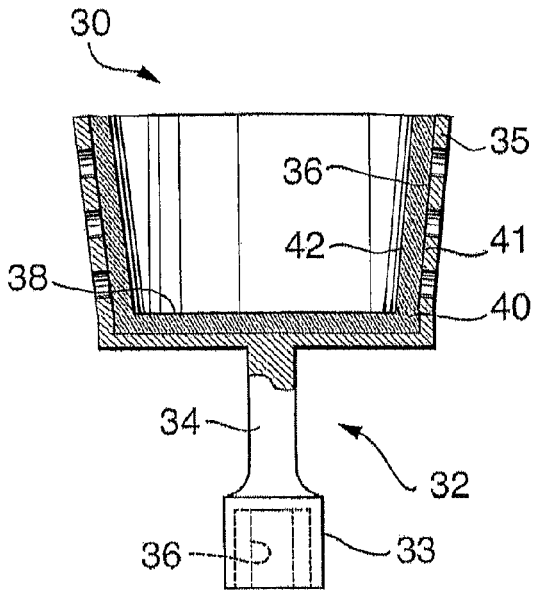
FIG. 3 is a series of three cross-sectional drawings of an exemplar male-threaded protector manipulator, FIG. 3*a* being of the flexible liner, cup and torque adapter, FIG. 3*b* being a compound elevation-cross-sectional view showing the interior of the solid cup, a portion of the flexible cup liner, and holes in the cup's walls, and FIG. 3*c* being a cross-section of the manipulator with the protector inserted and engaged, the protector being in turn engaged with the pin-end threads of a threaded tubular.
Figure 3B:
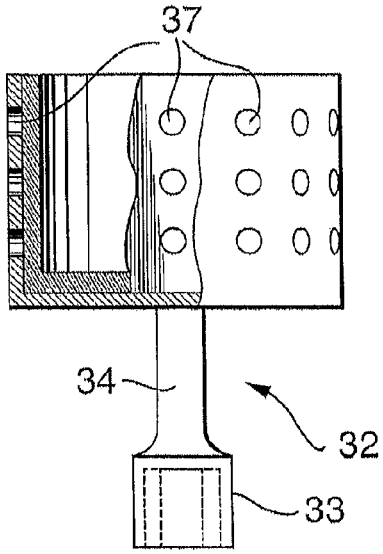
Figure 3C:
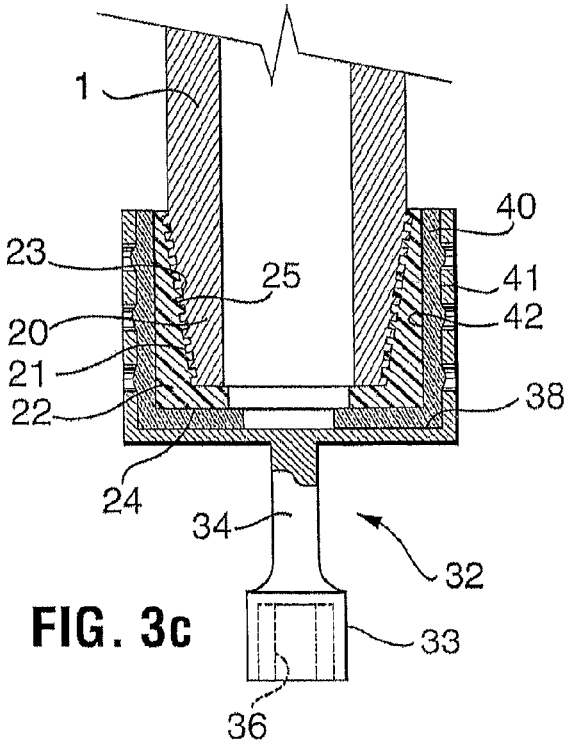

In one embodiment, the inner surface 42 of the flexible liner 40 can have sloped sides with the widest part near the open end of the liner 40 and a narrower part near the closed or cup-end of the liner 40, as shown for example in FIG. 3*a*. Similarly, the cup's lateral or side element may be frustoconical with its lateral side being sloped inward from a wider diameter at the open end to a narrower diameter at the closed or adapter end. Such a slope will permit the tool's user to cause a tighter frictional fit between the tool 30 and the thread protector 22 at the liner's face 42 by the user forcing the liner more deeply into the tool's cavity. One slope that has been found useful is 75-80°.

Similar to the use of the female-protector tool, the operator may engage the male-thread protector manipulator tool and spin the protector 22 to unscrew the protector 22 from the tubular's pin-end male threads 25 until a point when the protector 22 is nearly but not quite unscrewed, and then pull the flexible cup liner 40 and tool 30 from engagement with the protector 22 while the protector 22 is still engaged with the tubular 1, and then remove the protector 22 by manually spinning it from the threads 25.

In the preceding description, for purposes of explanation, numerous details are set forth in order to provide a thorough understanding of the embodiments of the invention. However, it will be apparent to one skilled in the art that these specific details are not required in order to practice the invention. Well-known structures (tubulars, threads, etc.) and protectors may be shown in generic form in order not to obscure the nature and working of this invention.

The above-described embodiments of the invention are intended to be examples only. Alterations, modifications and variations can be effected to the particular embodiments by those of skill in the art without departing from the scope of the invention, which is defined solely by the claims appended hereto.

What is claimed is:

1. A tool to manipulate a thread protector for the female threads of a threaded tubular, comprising:

a. A torque adapter attached to a flexible body;

b. The body being cylindrical or frusta-conical;

c. The body's outer diameter designed to frictionally engage an inner surface of the thread protector by application of linear force alone, pushing the body into the thread protector;

d. The torque adapter to transmit rotational forces to the protector via the body in order to spin the protector to screw or unscrew it from the threaded tubular.

2. A tool to manipulate a thread protector for the male threads of a threaded tubular, comprising:

a. A torque adapter attached to a solid cup;

b. A flexible cup-liner removably attached to the solid cup;

c. The flexible cup-liner shaped to temporarily receive and frictionally engage with the outer surface of the thread protector by application of linear force alone, pushing the flexible cup-liner against the outer surface of the thread protector;

d. The solid cup having voids in its outer walls;

e. The torque adapter to transmit rotational forces to the protector via the cup and flexible cup-liner in order to spin the protector to screw or unscrew it from the threaded tubular.

3. The tool of claim 2 where the cup's outer walls are cylindrical.

4. The tool of claim 2 where the cup's outer walls are frustoconical.

5. The tool of claim 2 where the cup-liner's internal void for receiving the protector is frusto-conical.

6. A method of screwing or unscrewing a thread protector from a threaded tubular, comprising the steps of:

a. Engaging a source of powered rotational motion to one end of a protector manipulator;

b. Frictionally engaging, by application of linear force alone, a protector-engagement means of the protector manipulator to the protector;

c. Invoking powered rotational movement to be supplied from the source to the protector manipulator to turn the protector in a direction.

7. The method of claim 6 with the added steps of:

d. Stopping the rotational movement imparted to the protector just before the protector is either fully engaged with or disengaged from the threaded tubular;

e. Disengaging the protector-engagement means of the protector manipulator from the protector.

* * * * *